United States Patent [19]

Lenhard et al.

[11] 4,126,565

[45] Nov. 21, 1978

[54] TONERS FOR COLOR FLASH FUSERS CONTAINING A PERMANENT COLORANT AND A HEAT SENSITIVE DYE

[75] Inventors: Myron J. Lenhard, Penfield; James D. Rees, Pittsford, both of N.Y.

[73] Assignee: Xerox Corporation, Stamford, Conn.

[21] Appl. No.: 754,807

[22] Filed: Dec. 27, 1976

[51] Int. Cl.[2] ..... G03G 9/10

[52] U.S. Cl. ..... 252/62.1 P; 96/1 SD; 96/1.2; 8/2; 8/4; 8/101; 8/102; 427/22; 219/216

[58] Field of Search ..... 96/1 SD, 1.2; 8/2, 4, 8/101, 102; 252/62.1 P, 62.1 L, 62.1 R; 427/22; 219/216

[56] References Cited

U.S. PATENT DOCUMENTS

| | | | |
|---|---|---|---|
| 3,345,293 | 10/1967 | Bartoszewicz et al. | 252/62.1 P |
| 3,474,223 | 10/1969 | Leiga et al. | 219/216 |
| 3,529,129 | 9/1970 | Rees | 219/216 |
| 3,679,351 | 7/1972 | Weissbein et al. | 8/2 |
| 3,832,212 | 8/1974 | Jenkins et al. | 428/913 |
| 3,844,815 | 10/1974 | Parent et al. | 96/1.2 |
| 3,900,318 | 8/1975 | Zographos et al. | 96/1.2 |
| 3,903,394 | 9/1975 | Mullen | 219/216 |
| 3,909,259 | 9/1975 | Mammino et al. | 96/1.2 |
| 3,998,747 | 12/1976 | Yamakami et al. | 252/62.1 P |

*Primary Examiner*—John D. Smith

[57] ABSTRACT

A toner and imaging system wherein the utilized toner is composed of a permanent colorant of the final color desired and additionally contains heat sensitive dye that darkens the color of the toner so that it more efficiently absorbs heat during flash fusing but then decomposes, becoming colorless, to leave an image the color of the permanent colorant.

7 Claims, No Drawings

TONERS FOR COLOR FLASH FUSERS CONTAINING A PERMANENT COLORANT AND A HEAT SENSITIVE DYE

BACKGROUND OF THE INVENTION

This invention relates to electrophotographic toners and in particular to toners for utilization in flash or radiant fusing which are heat and light sensitive.

The formation and development of images on the surface of photoconductor materials by electrostatic means is well known. The basic electrophotographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the electroscopic particles to the electrostatic latent image to be developed. One development method, as disclosed by E. N. Wise in U.S. Pat. No. 2,618,552 is known as cascade development. Another method of developing electrostatic latent images is the "magnetic brush" process as disclosed, for example, in U.S. Pat. Nos. 2,874,063; 3,103,445; 3,251,706 and 3,357,402. In this method, a developer material containing toner and magnetic carrier particles is carried by a magnet. The magnetic field of the magnet causes alignment of the magnetic carrier into a brush-like configuration. This "magnetic brush" is engaged with the electrostatic latent image-bearing surface and the toner particles are drawn from the brush to the electrostatic latent image by electrostatic attraction. Other methods of development include "powder cloud" development as disclosed, fo example, by C. F. Carlson in U.S. Pat. No. 2,221,776; "touchdown" development as disclosed by R. W. Gundlach in U.S. Pat. Nos. 3,166,432 and 3,245,823 by Mayo; and "Cascade" development described in U.S. Pat. No. 3,099,943.

Although all of the above mentioned developing techniques and other are presently used almost exclusively for black and white reproduction, they are capable of forming images in other colors and combinations of colors. As in other color systems, electrostatographic color systems are generally based on trichromatic color synthesis of either the additive or substrative color formation types. Thus, where electrostatographic systems are operated in full color, toner or developing particles of at least three different colors must be employed to synthesize any other desired color. As a rule, at least three-color separation images are formed and combined in register with each other to form a colored reproduction of a full colored original. In color electrophotography, as described, for example, in U.S. Pat. No. 2,962,374 to Dessauer, at least three electrostatic latent images are formed by exposing an electrostatographic plate to different optical color separation images. Each of these electrostatic latent images is developed with a different colored toner, after which the three-toner images are combined to form the final image. This combination of the three-color toner images is generally made on a copy sheet, such as paper, to which the toner images are permanently affixed. The most common technique for fixing these toner images to the paper copy sheet is by employing a resin toner which includes a colorant and heat fusing the toner images to this copy sheet. Images may be fixed by other techniques such as, for example, subjecting them to a solvent vapor. Color "highlight" systems wherein a copier may contain black and one or two highlight colors are also known. Such a copier can produce either black copies, single color copies of another color or black copies with color highlighted areas.

Many forms of image fixing techniques are known in the prior art, the most prevalent of which are vapor fixing, heat fixing, pressure fixing or a combination thereof. Each of these techniques, by itself or in combination, suffer from deficiencies which make their use impractical or difficult for specific xerographic applications. In general it has been difficult to construct an entirely satisfactory heat fuser such a a roll fuser, having a short warm up time, high efficiency, and ease of control. A further problem associated with heat fusers, especially radiant fusers, has been their tendency to burn or scorch the support material. Pressure fixing methods, whether heated or cold, have created problems with image offsetting, resolution degradation and producing consistently a good class of fix. On the other hand, vapor fixing which typically employs a solvent has proven commercially unfeasible because of the odor and solvent recovery problems involved. Equipment to sufficiently isolate the fuser from the surrounding ambient air must by its very nature be complex and costly.

With the advent of new materials and new xerographic processing techniques, it is now feasible to construct automatic xerographic reproducing apparatus capable of producing copy at an extremely rapid rate. Radiant flash fusing is one practical method of image fixing that will lend itself readily to use in a high speed automatic process. The main advantage of the flash fuser over the other known methods is that the energy, which is propagated in the form of electromagnetic waves is instantaneously available and requires no intervening medium for its propagation. As can be seen, such apparatus does not require long warm up periods nor does the energy have to be transferred through a relatively slow conductive or convective heat transfer mechanism.

Although the flash fusing systems such as disclosed in U.S. Pat. No. 3,903,394; U.S. Pat. Nos. 3,474,223 and 3,529,129 of the prior art perform satisfactorily with the black toner of conventional copying processes, the flash fusing is not as efficient when fusing colored toners. Colored toners absorb much less light and therefore greater energy input to fuse than black toners. Further, when copying a full color image which contains portions which are black and portions of low light absorbing colors such as yellow the flash fusing is difficult as there is a tendency either to overfuse the black portions in order to fuse the yellow or conversely to not effectively fuse the yellow although the black and darker colors are properly fused. Proper flash fusing of images of mixed colors requires a narrow range of energy input to achieve complete fusing. It is difficult to maintain in a commercial copier narrow parameters such as a narrow range of flash fusing energy input for a long period of time. Therefore as can be seen it would be desirable if it was possible to fuse full color images which would absorb substantially equally the output of a flash fuser. Further there is a need for a method of flash fusing colored toner images such that uneven fusing does not give an irregular surface appearance.

SUMMARY OF THE INVENTION

It is therefore an object of this invention to provide toners overcoming the above-noted disadvantages.

It is a further object of this invention to provide fused color images of uniform appearance.

It is an additional object of this invention to provide energy efficient fusing of colored toner images.

It is a further additional object of this invention to enable flash fusing of color images without scorching of the substrate.

It is a further object of this invention to provide efficient flash fusing of low light absorbing color images.

It is a further additional object of this invention to provide efficiently fusable toners for color imaging.

It is another object to provide an efficient method of flash fusing colored toners.

These and other objects of the invention are accomplished by providing an electrophotographic toner comprising a resin material, permanent pigment or dye and heat or heat and light sensitive dye. The heat sensitive dyes are added to the toner in such a manner that a darker more light absorbing color results than when only the permanent color is present. The heat sensitive dyes however during flash fusing absorb the light, are decomposed and become bleached to a colorless or almost colorless state.

In one form of the invention cyan and magenta heat sensitive dyes may be added to a toner having a permanent yellow pigment. This forms a black toner which is very light absorbing. When the toner is subjected to the radiation from a flash fuser the cyan and magenta dyes decompose and become colorless thereby leaving a yellow image that was during the fusing as absorbent of light as black toner but results in a yellow image.

DETAILED DESCRIPTION OF THE INVENTION

The invention encompasses the addition of heat sensitive dyes to a pigmented toner in such a manner that a great increase in light absorbtive properties of the toner results. While the preferred method is to bring the toner as close to black as possible; the efficiency of dark brown or dark navy blue colors is almost as high as black and they are eminently suitable for flash fusing. The heat sensitive dyes of the invention are generally decomposed at the same temperature or a slightly lower temperature than that necessary to lower the viscosity of the resin enough for it to fuse. Generally heat sensitive dyes are preferred in order that storage of the toner in the dark is not necessary. However in the ordinary processes of manufacturing and shipping toner it is not generally exposed to the light and light and heat sensitive dyes may be used with some extra care.

Any dye which is light or light and heat sensitive in the temperature ranges normally utilized for fusing and which decomposes to a colorless or near colorless state may be utilized in the instant invention. Preferred are dark brown or black dyes or cyan, magenta and yellow dyes which may be combined to obtain black. Combinations of subtractive and additive dye colors also may be utilized to give dark colors, i.e., cyan and red. The term heat sensitive dye as used is defined as those dyes which upon heating decompose to form substantially colorless products. Light and heat sensitive dyes are defined as those that decompose to form substantially colorless products upon exposure to heat or light. Typical of suitable heat sensitive dyes and light and heat sensitive dyes are those disclosed in U.S. Pat. No. 3,832,212 which is hereby incorporated by reference. Such dyes are heat sensitive compounds containing heterocyclic nitrogen atoms substituted with an —OR group fragment. Suitable for the invention are structures as follows

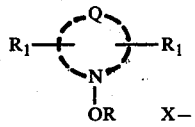

wherein $Q_1$ represents the non-metallic atoms necessary to complete a sensitizing or desensitizing nucleus containing 5 or 6 atoms in the heterocyclic ring which nucleus can contain at least one additional hetero atom such as oxygen, sulfur, selenium or nitrogen, i.e., a nucleus of the type used in the production of cyanine dyes. $R_1$ represents a hydrogen atom, an alkyl group (preferably a lower alkyl containing 1–4 carbon atoms) X represents an acid anion for instance chloride, bromide or iodide. R represents either (1) an alkyl radical containing a substituted alkyl preferably a lower alkyl having 1–4 carbon atoms or (2) a acyl radical. Such compounds generally display good heat sensitivity without being overly sensitive to light such as to require special handling. The heat sensitive dyes 1-ethoxy-3′-ethyl-2-pyridothiacyanine tetrafluoroborate (yellow),
3-ethyl-1-methoxy-2-pyridothiacarbocyanine perchlorate (cyan), and
3′-ethyl-1-methoxy-4′,5′-benzo-2-pyridothiacarbocyanine perchlorate (magenta)

have been found to be effective in combinations to yield black or near black toners. The heat sensitive dyes of the instant invention may be combined with any suitable pigment or dye which is not heat sensitive for formation of toners in accordance with the invention.

Permanent toner colorants are well known and include for example calico oil blue, chrome yellow, ultramarine blue, DuPont oil red, quinone yellow, methylene blue chloride, phthalocyanine blue, rose bengal and mixtures thereof. Permanent colorants are defined herein as those pigments and dyes exhibiting good color stability at temperatures ordinarily involved in fusing of electrophotographic toners. The permanent pigment or dye should be present in the toner in a sufficient quantity to render it highly colored so that it will form a visible image on the recording member. Preferably, a permanent pigment is employed in an amount from about 3 to about 20% by weight based on the total weight of the colored toner. Permanent dyes may be used in smaller quantities. Suitable permanent colorants for the toners of the instant invention are the toluene-2-napthol dyes such as Colour Index Solvent Red 24 Colour Index number 26105, Colour Index Solvent Red 25, Colour Index number 26110, Basic Red, Color Index number 26115, and Colour Index Solvent Red 26, Colour Index number 26120. Copper-tetra-4-4(octadecylsulfonamido) phthalocyanine, 2,9,-dimethylquinacquindone Pigment Red 122, 3,3-dichlorobenzedene acetylacetanilide pigment Colour Index Pigment Yellow 12.

Any suitable resin material may be used for the toner compositions of the present invention. Substantially transparent resins are preferred when the toner is to be used in a color electrophotographic system. Although any substantially transparent resin material may be utilized as the resin component of this toner, it is preferable that resins having other desirable properties be utilized in this invention. Thus, for example, it is desirable that a resin be used which is a non-tacky solid at room temperature so as to facilitate handling and use in the most common electrophotographic processes. Thermal plastics are desirable with melting points significantly above room temperature, but below that of which ordinary paper tends to char so that once the toner images from thereon or transfer to a paper copy sheet it may be fused in place by subjecting it to heat. The resins selected should desirably have good triboelectric properties and have sufficient insulating properties to hold charge so that they may be employed in a number of development systems.

While any suitable transparent resin possessing the properties as above described may be employed in the system of the present invention, particularly good results are obtained with the use of vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene; p-chlorostyrene; vinyl naphthalene; ethylencally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrol, N-vinyl carbazole, N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization technique such as free radical, anionic and cationic polymerization processes. Any of these vinyl resins may be blended with one or more other resins if desired, preferably other vinyl resins which insure good triboelectric stability and uniform resistance against physical degradation. However, non-vinyl type thermoplastic resins may also be employed including resin modified phenol formaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

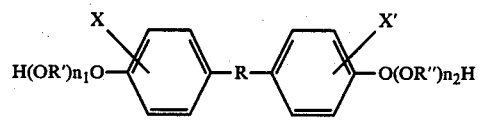

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' represent substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Optimum results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxypropoxy-phenyl)-propane, 2,2-bis(4-hydroxy-propoxy-phenyl) propane, 1,1-bis(4-hydroxy-ethoxy-phenyl)-butane, 1,1-bis(4-hydroxy isopropoxy-phenyl) heptane, 2,2-bis(3-methyl-4-betahydroxy ethoxy-phenyl) propane, 1,1-bis(4-beta hydroxy ethoxy phenyl)- cyclohexane, 2,2'-bis(4-beta hydroxy ethoxy phenyl)-norbornane, 2,2'-bis(4-beta hydroxy ethoxy phenyl)norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n_3}\ COOH$$

wherein R''' represents a substituted or unsubstituted alkylene radicl having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist and formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resin modified phenol formaldehyde resin, oil modified epoxy resins, polyurethane resins, cellulosic resins, vinyl type resins and mixture thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Re. Pat. No. 25,136 to Carlson and polystyrene blends as described in U.S. Pat. No. 2,788,288 to Rheinfrank and Jones.

Any well known toner mixing and comminution technique may be employed to provide the toner compositions of the instant invention. For example, the ingredients may be thoroughly mixed by blending and milling and thereafter micropulverized. In addition, spray drying a suspension of the ingredients, or a solution of the toner composition may also be employed. Spray drying is preferred as it may be performed without raising the temperature of the heat sensitive pigment.

Precautions must be taken in blending the heat sensitive colorant with the permanent colorant and resin so that the heat sensitive component does not decompose during processing. Spray drying techniques such as disclosed in U.S. Pat. Nos. 3,326,848 and 3,502,582 have been found to be well suited to processing heat sensitive materials. Hot melt blending techniques can be employed with dyes that have high decomposition temperatures but are not as satisfactory as spray drying.

Where carrier materials are employed in connection with the toner compositions of the instant invention in cascade and magnetic brush development, the carrier particles employed may be electrically conductive, insulating, magnetic or nonmagnetic, as long as the carrier particles are capable of triboelectrically obtaining a charge of opposite polarity to that of the toner particles so that the toner particles adhere to and surround the carrier particles. In developing a positive reproduction of an electrostatic image, the carrier particle is selected so that the toner particles acquire a charge having a polarity opposite to that of the electrostatic latent image so that toner deposition occurs in image areas. Alternatively, in reversal reproduction of an electrostatic latent image, the carriers are selected so that the toner particles acquire a charge having the same polarity as that of the electrostatic latent image resulting in toner deposition in the non-image areas. Typical carrier materials include: sodium chloride, ammonium chloride, aluminum potassium chloride, Rochelle salt, sodium nitrate, aluminum nitrate, potassium chlorate, granular zircon, granular silicon, methyl methacrylate, glass, steel, nickel, iron, ferrites, ferromagnetic materials, silicon dioxide and the like. The carriers may be employed with or without a coating. Many of the foregoing and typical carriers are Many of the foregoing and typical carriers are described by L. E. Walkup in U.S. Pat. No. 2,618,551; L. E. Walkup et al in U.S. Pat. No. 2,638,416; E. N. Wise in U.S. Pat. No. 2,618,552; R. H. Hagenbach et al in U.S. Pat. Nos. 3,591,503 and 3,533,835 directed to electrically conductive carrier coatings, and B. J. Jacknow et al in U.S. Pat. No. 3,526,533 directed to methyl terpolymer coated carriers which are the reaction products of organo silanes, silanols or siloxanes with unsaturated polymerizable organic compounds (optimum among those disclosed are terpolymer coatings achieved with a terpolymer formed from the addition polymerization reaction between monomers or prepolymers of: styrene, methylmethacrylate and unsaturated organo silanes, silanols or siloxanes); and nickel berry carriers as disclosed in Ser. No. 357,988, filed May 7, 1973, now U.S. Pat. No. 3,847,604, Division of Ser. No. 151,995, filed June 10, 1971, now U.S. Pat. No. 3,767,598. Nickel berry carriers are modular carrier beads of nickel characterized by a surface of recurring recesses and protrusions giving the particles a relatively large external surface area. An ultimate coated carrier particle diameter between about 50 microns to about 1000 microns is preferred because the carrier particles then possess sufficient density and inertia to avoid adherence to the electrostatic images during the cascade development process. The carrier may be employed with the toner composition in any suitable combination, generally satisfactory results have been obtained when about 1 part toner is used with about 10 to about 200 parts by weight of carrier.

The toners of the instant invention also may be utilized in systems such as powder cloud development which do not require any carrier.

The electrostatic latent images developed by the toner compositions of the instant invention may reside on any surface capable of retaining charge. In electrophotographic applications a photoconductive member is employed to form the electrostatic latent image. The photoconductive member is employed to form the electrostatic latent image. The photoconductive layer may comprise an inorganic or an organic photoconductive material. Typical inorganic materials include: sulfur, selenium, zinc sulfide, zinc oxide, zinc cadmium sulfide, zinc magnesium oxide, cadmium selenide, zinc silicate, calcium strontium sulfide, cadmium sulfide, 4-dimethylaminobenzylidene benzhydrazide; 3-benzylideneamino-carbazole; polyvinyl carbazole; (2-nitro-benzylidene)-p-bromo-aniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-trinitrofluorenone charge transfer complex; phthalocyanines and mixtures thereof.

The flash fusing system for use in the fusing process utilizing the toner of the instant invention may be any of the known flash fusers such as disclosed in U.S. Pat. Nos. 3,529,129 to Rees, 3,903,394 to Mullen and 3,474,223 to Leiga. A flash fuser generally utilizes a Xenon flash lamp. The output of the lamp is primarily in the visible and near infrared wavelengths. The output of the flash lamp is measured by joules using the capacitor bank energy and the formula $1/2\ CV^2$ wherein C is capacitance and V is voltage.

To further define the specifics of the present invention, the following examples are intended to illustrate and not limit the particulars of the present system. Parts and percentages are by weight unless otherwise indicated.

EXAMPLE I

A spray drying solution is formed by dispersing 200 gms. of styrene-n-butylmethacrylate copolymer resin in 1000 gms of toluene. To this solution is added 8 gms of the permanent pigment copper tetra-4-(octadecylsulfonamido) phthalocyanine pigment (cyan), 6 gms of heat sensitive 3-ethyl-1-methoxy-4',5-benzo-2-pyridothiacarbocyanine perchlorate (magenta), 6 gms of heat sensitive 1-ethoxy-3'-ethyl-2-pyridothiacyanine tetrafluoroborate (yellow). This mixture is blended and then is spray dried by a spinning disc-type atomizer at a feed rate of about 80 milliliters per minute, a pressure of about 75 p.s.i., a feed temperature of about 160° F., a drying air input at about 190° F. and an output temperature of about 160° F. to give toner particles of about 15 microns average size. The toner particles are combined with a conventional carrier and utilized to develop an electrostatic latent image. The image on white $8\frac{1}{2} = 11$ paper is fused in a fuser of U.S. Pat. No. 3,529,129 using light from a Xenon flash tube at a stored energy of 800 joules. The toner prior to flash fusing appears black in color. The toner developed and fused to provide excellent cyan images.

EXAMPLE II

The process of Example I is performed except that the permanent pigment 2,9-dimethylquinacquidone pigment (magneta) was substituted for the cyan pigment and heat sensitive 3'-ethyl-1-methoxy-2-pyridothiacarbocyanine perchlorate (cyan) was substituted for the magenta dye. This toner also appears substantially black prior to fusing but after flash fusing gives a clear sharp magenta image.

EXAMPLE III

The process of Example I is performed except that the permanent colorant Colour Index Yellow 29, Colour Index No. 21230 was substituted for the heat sensitive yellow dye and the photosensitive cyan dye of Example II is substituted for the cyan pigment of Example I. This resulted in a toner that appears to be black to visual inspection but gives clear sharp yellow images after fusing.

EXAMPLE IV

Utilizing the Xerox 6500 a sequential full color imaging process such as disclosed in U.S. Pat. No. 3,804,618 is performed utilizing the toners of Examples I–III for the cyan, magenta and yellow toners in the copier. The copy prior to flash fusing appears to visual inspection to be uniform black in the image areas. However after exposure to flash fusing a full color image is obtained.

EXAMPLE V

A toner is formed by the method of Example I utilizing a permanent color comprising O-toluidene-2-5-xylidene-2-naphthol (Colour Index solvent red 26, Colour Index No. 26120) in an amount of about 8 grams and 12 grams of each of the heat sensitive magenta and cyan dyes of Examples I and II. This toner when sprayed dryed is a dark color. Flash fusing is successfully carried out to yield a red image.

EXAMPLE VI

The toner of Example I is transferred in image configuration to a sheet already bearing a black styrene n-butylmethacrylate carbon pigment containing toner image. Simultaneous flash fusing of each image at several different power settings indicates that in each case both images are fused to the approximate same degree. This is an indication that the light absorption is substantially the same.

EXAMPLE VII

As a control, a cyan toner formed without heat sensiive dye but with the permanent cyan pigment of Example I is transferred to a substrate already having thereon a styrene-n-butylmethacrylate carbon pigment loaded toner. Flash fusing is performed at several power settings about 700, 800 and 900 joules for the flash fuser. The fused images vary with different image quality being obtained in each case due to uneven fusing.

Although specific colorant combinations are given in toner formulations above, it is to be recognized that any suitable permanent colorant and any heat and/or light sensitive resin may be utilized in the toner formulations. Even though the advantages of the instant toners with flash fusing were stressed advantages are also apparent with tungsten filament radiant fusers although process parameters for such radiant fusers are different than for flash fusing. Tungsten filament radiant fusers primarily give off infrared wavelength energy and dyes sensitive to this energy would be preferred for fusing utilizing radiant fusers. While certain ratios of resin to permanent colorant to light and heat sensitive colorant were described above these are not to be considered as absolutely critical and they may vary depending upon fusing conditions and final color of the product desired.

Although specific materials and conditions are set forth in the foregoing examples they are merely intended as illustrations of the present invention. Whereas other suitable toner resins, additives and other components such as listed above may be substituted in those examples with similar results, other materials such as wetting agents or fillers may be added to the toner to sensitize, synergize or otherwise improve the properties of the system such as for example to reduce humidity sensitivity.

Other modifications of the present invention will occur to those skilled in the art upon reading of the present disclosure. These are intended to be within the scope of this invention. For instance magnetic particles may be added to the toner for use in magnetic development systems.

What is claimed is:

1. A developer comprising carrier particles and toner particles wherein said toner comprises resin, permanent colorant and heat sensitive dye wherein said dye upon heating decomposes to form substantially colorless products.

2. The developer of claim 1 wherein said heat sensitive dye is also light sensitive and decomposes to substantially colorless products upon exposure to light and heat.

3. The developer of claim 1 wherein said heat sensitive dye bleaches to become substantially colorless when exposed to heat.

4. The developer of claim 1 wherein said permanent colorant comprises a pigment.

5. The developer of claim 1 wherein said heat sensitive dye is selected from the group comprising 1-ethoxy-3′-ethyl-2-pyridothiacyanine tetrafluoroborate, 3′-ethyl-1-methoxy-2-pyridothiacarbocyanine perchlorate, 3′-ethyl-1-methoxy 4′,5′-benzo-2-pyridothiacarbocyanine tetrafluoroborate and mixtures thereof.

6. The developer of claim 1 wherein said permanent colorants comprise one of cyan, magenta or yellow and said heat sensitive dye is comprised of a mixture of the remaining two colors of the cyan, magenta and yellow group.

7. The developer of claim 1 wherein said heat sensitive dye is black.

* * * * *